US011610526B2

(12) United States Patent
He et al.

(10) Patent No.: US 11,610,526 B2
(45) Date of Patent: Mar. 21, 2023

(54) DISPLAY PANEL, METHOD OF CONTROLLING DISPLAY PANEL

(71) Applicant: HKC CORPORATION LIMITED, Guangdong (CN)

(72) Inventors: Huan He, Guangdong (CN); Wei Fu, Guangdong (CN); Haijiang Yuan, Guangdong (CN)

(73) Assignee: HKC Corporation Limited, Guangdong (CN)

( * ) Notice: Subject to any disclaimer, the term of this patent is extended or adjusted under 35 U.S.C. 154(b) by 143 days.

(21) Appl. No.: 17/190,581

(22) Filed: Mar. 3, 2021

(65) Prior Publication Data

US 2022/0036785 A1 Feb. 3, 2022

(30) Foreign Application Priority Data

Jul. 28, 2020 (CN) ..... 202010749459.7

(51) Int. Cl.
*G09G 3/20* (2006.01)

(52) U.S. Cl.
CPC ..... *G09G 3/20* (2013.01); *G09G 2310/027* (2013.01); *G09G 2310/08* (2013.01); *G09G 2330/028* (2013.01)

(58) Field of Classification Search
None
See application file for complete search history.

(56) References Cited

U.S. PATENT DOCUMENTS

2009/0167846 A1* 7/2009 Niioka ..... G02F 1/133555 348/54
2010/0156771 A1* 6/2010 Lee ..... G09G 3/3648 345/87

FOREIGN PATENT DOCUMENTS

| | | | |
|---|---|---|---|
| CN | 102625132 | A | 8/2012 |
| CN | 207380420 | U | 5/2018 |
| CN | 208795983 | U | 4/2019 |
| CN | 111028761 | A | 4/2020 |
| EP | 2280391 | A1 | 2/2011 |

OTHER PUBLICATIONS

Chinese Office Action, dated Feb. 8, 2021, for Hui ke co., ltd., Chinese Application No. 202010749459.7, filed Jul. 28, 2020.

* cited by examiner

*Primary Examiner* — Ifedayo B Iluyomade
(74) *Attorney, Agent, or Firm* — Law Offices of Albert Wai-Kit Chan, PLLC

(57) ABSTRACT

Disclosed are a display panel, a method of controlling the display panel. The display panel includes multiple pixel groups arranged in an array, wherein each pixel group comprises a first sub-pixel and a second sub-pixel which are adjacently arranged; a plurality of gate lines, wherein the first sub-pixel and the second sub-pixel in a same row of the array are connected to one gate line; a plurality of first data lines, wherein the first sub-pixels in a same column of the array are connected to one first data line; a plurality of second data lines. The second sub-pixels in a same column of the array are connected to one second data line of the plurality of second data lines; the first and the second data lines are spacedly arranged, and a driving component to which the gate lines, the first data lines and the second data lines are connected.

18 Claims, 6 Drawing Sheets

DISPLAY PANEL, METHOD OF CONTROLLING DISPLAY PANEL

CROSS REFERENCE TO RELATED APPLICATIONS

The present application claims the priority of Chinese Patent Application filed in the National Intellectual Property Administration on Jul. 28, 2020, with the application number 202010749459.7 and Title "Display panel, method of controlling display panel", the entire contents of which are hereby incorporated by reference.

TECHNICAL FIELD

The present disclosure relates to the technical field of display, in particular to a display panel, a method of controlling the display panel.

BACKGROUND

The display panel cannot be switched between various display modes according to the needs of users once the manufacture has been completed. For example, the current display panel cannot be switched between high resolution mode and wide angle mode, limiting the display panel within a single display mode.

The aforementioned is assistant in understanding the technical solution of the present application, and does not necessarily admit that the aforementioned constitutes the prior art.

SUMMARY

The present disclosure is to provide a display panel and a method of controlling the display panel, to improve the simplicity of display mode for a display panel.

In order to achieve the above object, the present disclosure provides a display panel, and the display panel includes a plurality of pixel groups arranged in an array, where each pixel group includes a first sub-pixel and a second sub-pixel which are adjacently arranged; a plurality of gate lines, where the first sub-pixels and the second sub-pixels in a same row of the array are connected to one gate line of the plurality of gate lines; a plurality of first data lines, wherein the first sub-pixels in a same column of the array are connected to one first data line of the plurality of first data lines; a plurality of second data lines, wherein the second sub-pixels in a same column of the array are connected to one second data line of the plurality of second data lines; the first and the second data lines are spacedly arranged, and a driving component to which the gate lines, the first data lines and the second data lines are connected.

In one embodiment, the driving component includes a main board circuit connected with a timing controller, where the timing controller includes a control pin; a switch circuit connected to the control pin of the timing controller; a gate driver connected to the timing controller and the plurality of gate lines; and a source driver connected to the timing controller, the first and the second data lines.

In one embodiment, the switch circuit includes a pull-up resistor, a control switch and a pull-up power supply, where the pull-up power supply is connected to the control pin via the control switch, and the pull-up power supply is grounded via the control switch and the pull-up resistor.

In one embodiment the control switch is a physical key switch, and the timing controller is to receive a control signal triggered by the physical key switch.

In one embodiment, the control switch is an electronic switch, the electronic switch is controlled on and off by a software, and the timing controller is to receive a control signal triggered by the electronic switch.

In order to achieve the above object, another aspect of the present disclosure provides a method of a display panel. The display panel includes a plurality of pixel groups arranged in an array, a plurality of gate lines, a plurality of first data lines, a plurality of second data lines, a control component, and a memory, where each pixel group includes a first sub-pixel and a second sub-pixel which are adjacently arranged; first sub-pixels and second sub-pixels in a same row of the array are connected to one gate line of the plurality of gate lines; the first sub-pixels in a same column of the array are connected to one first data line of the plurality of first data lines; the second sub-pixels in a same column of the array are connected to one second data line of the plurality of second data lines; the first data lines and the second data lines are spacedly arranged, and the gate lines, the first data lines and the second data lines are connected to the control component, where the control method further includes:

upon receiving a first switching signal, setting, by the control component, pixel voltages of the first sub-pixel and the second sub-pixel in each pixel group to respective corresponding gray-scale voltages;

upon receiving the second switching signal, setting, by the control component, the pixel voltage of the first sub-pixel in the pixel group as the corresponding gray-scale voltage, and setting the pixel voltage of the second sub-pixel as a target voltage, where there is a fixed voltage difference between the target voltage and the gray-scale voltage of the first sub-pixel.

In one embodiment, the control component includes a main board circuit, a timing controller, a source driver and a gate driver, where the timing controller is connected with the main board circuit, the gate driver and the source driver, and the operation of upon receiving a first switching signal, setting, by the control component, pixel voltages of the first sub-pixel and the second sub-pixel in each pixel group to respective corresponding gray-scale voltages, comprises:

upon receiving input data, controlling the timing controller to acquire red, green and blue data from the input data;

converting, by the source driver, the red, green and blue data into corresponding gray-scale voltages through a digital-to-analog conversion module;

setting pixel voltages of the first sub-pixel and the second sub-pixel as respective corresponding gray-scale voltages.

In one embodiment, the display panel further includes a memory, and the operation of upon receiving the second switching signal, setting, by the control component, the pixel voltage of the first sub-pixel in each pixel group as the corresponding gray-scale voltage, and setting the pixel voltage of the second sub-pixel as a target voltage, comprises:

acquiring a preset fixed voltage difference between the first sub-pixel and the second sub-pixel in the pixel group from the memory, after acquiring the gray-scale voltage corresponding to the first sub-pixel;

acquiring the target voltage of the second sub-pixel according to the gray scale voltage corresponding to the first sub-pixel and the fixed voltage difference;

setting the pixel voltage of the second sub-pixel as the target voltage.

In one embodiment, the method further includes:

in response that a level of the control pin of the timing controller is switched according to a first switching direction, determining to receive a first switching signal;

in response that a level of the control pin of the timing controller is switched according to a second switching direction, determining to receive a second switching signal;

wherein the first switching direction is opposite to the second switching direction.

In order to achieve the above object, another aspect of the present disclosure provides a method of a display panel. The display panel comprises a plurality of pixel groups arranged in an array, in which each pixel group includes a first sub-pixel and a second sub-pixel which are adjacently arranged; a plurality of gate lines, wherein the first sub-pixel and the second sub-pixel in a same row of the array are connected to one gate line of the plurality of gate lines; a plurality of first data lines, wherein the first sub-pixels in a same column of the array are connected to one first data line of the plurality of first data lines; a plurality of second data lines, wherein the second sub-pixels in a same column of the array are connected to one second data line of the plurality of second data lines; the first and the second data lines are spacedly arranged, and a driving component to which the gate lines, the first data lines and the second data lines are connected, and memory, wherein the control method further comprises:

upon receiving a first switching signal, setting, by the control component, pixel voltages of the first sub-pixel and the second sub-pixel in each pixel group to respective corresponding gray-scale voltages;

upon receiving a second switching signal, acquiring a preset fixed voltage difference between a first sub-pixel and a second sub-pixel in the pixel group from the memory, acquiring a target voltage of the second sub-pixel according to a gray scale voltage corresponding to the first sub-pixel, and the fixed voltage difference, and setting the pixel voltage of the second sub-pixel as the target voltage.

According to the present disclosure, the driving component is connected to the gate line, the first sub-pixels and the second sub-pixels in the same column are connected to the same first data line, and the second sub-pixels in the same column are connected to the same second data line, Gray scale voltages corresponding to display modes are input to the first sub-pixels and the second sub-pixels of all pixel groups respectively through the first data lines and the second data lines, so that the display panel is switched between high resolution and wide angle modes, and various display requirements of users are met.

Figure 1:
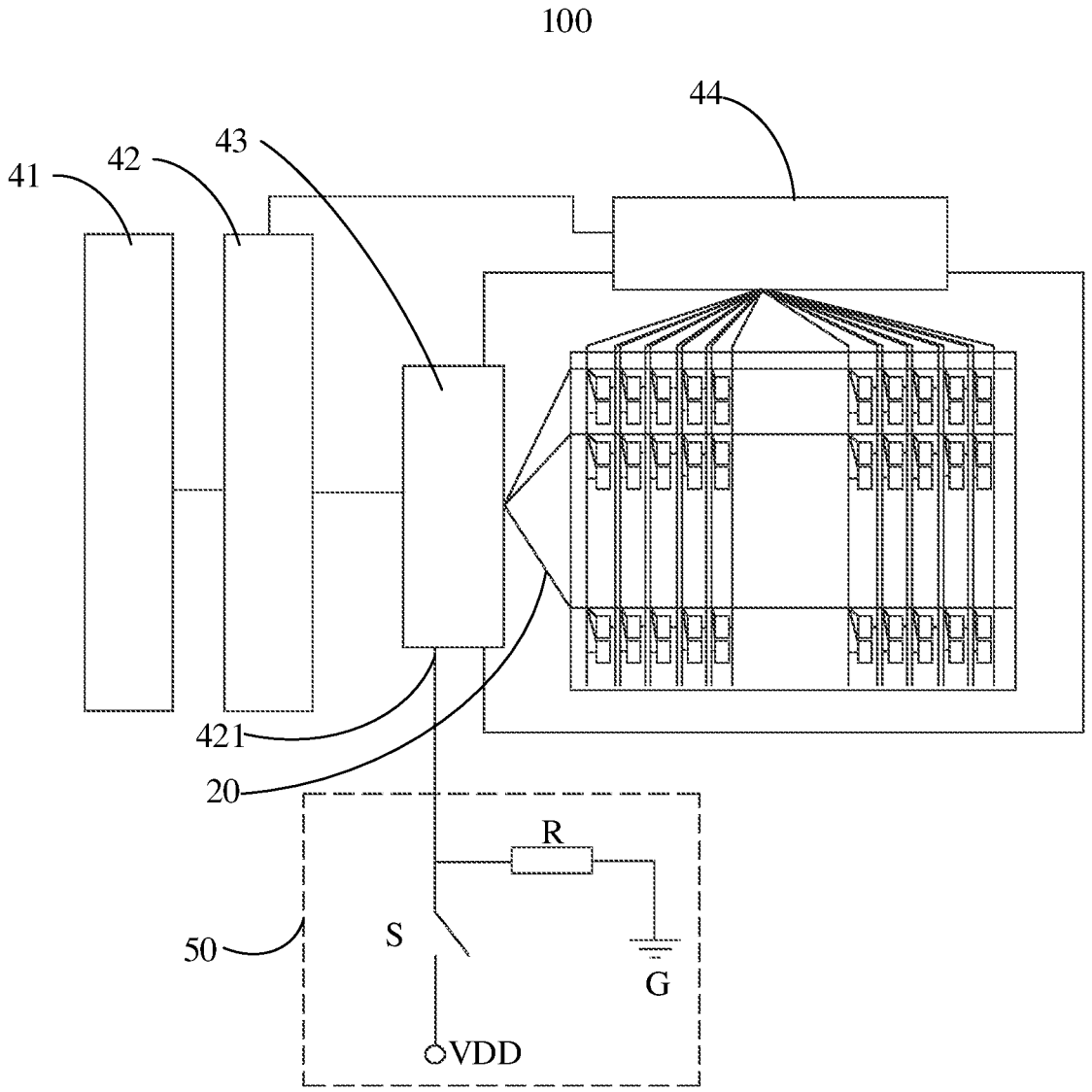
FIG. 1 is a schematic structural diagram showing a display panel according to an embodiment of the present disclosure.

The implementation, functional features and advantages of the present application will be further described with reference to the accompanying drawings with the embodiments.

DETAILED DESCRIPTION OF THE EMBODIMENTS

As following, the technical solution in the embodiments of the present disclosure will be described clearly and completely with reference to the drawings in the embodiment of the present application. Obviously, the described embodiment is only a part of the embodiment of the present application, not all of the embodiments. Based on the embodiments in the present application, all other embodiments perceived by those ordinary skills in the art without creative effort should be fallen within the protection scope of the present application.

It should be noted that all directional indicators (such as upper, lower, left, right, front, rear, etc.) in the embodiment of the present application are only used to explain the relative positional relationship, movement, etc. between various components under a certain specific posture (as shown in the drawings). If the specific posture changes, the directional indicator will also change accordingly.

In addition, the descriptions related to "first", "second" and the like in the present application are for descriptive purposes only and cannot be understood as indicating or implying its relative importance or implicitly indicating a number of technical features indicated. Thus, features defining "first" and "second" may explicitly or implicitly include at least one of the features. In addition, the technical solutions between the various embodiments may be combined with each other, but must be based on what one of ordinary skill in the art can achieve. When the combination of technical solutions is contradictory or impossible to achieve, it should be considered that the combination of such technical solutions does not exist and is not within the protection scope required by the present application.

Figure 2:
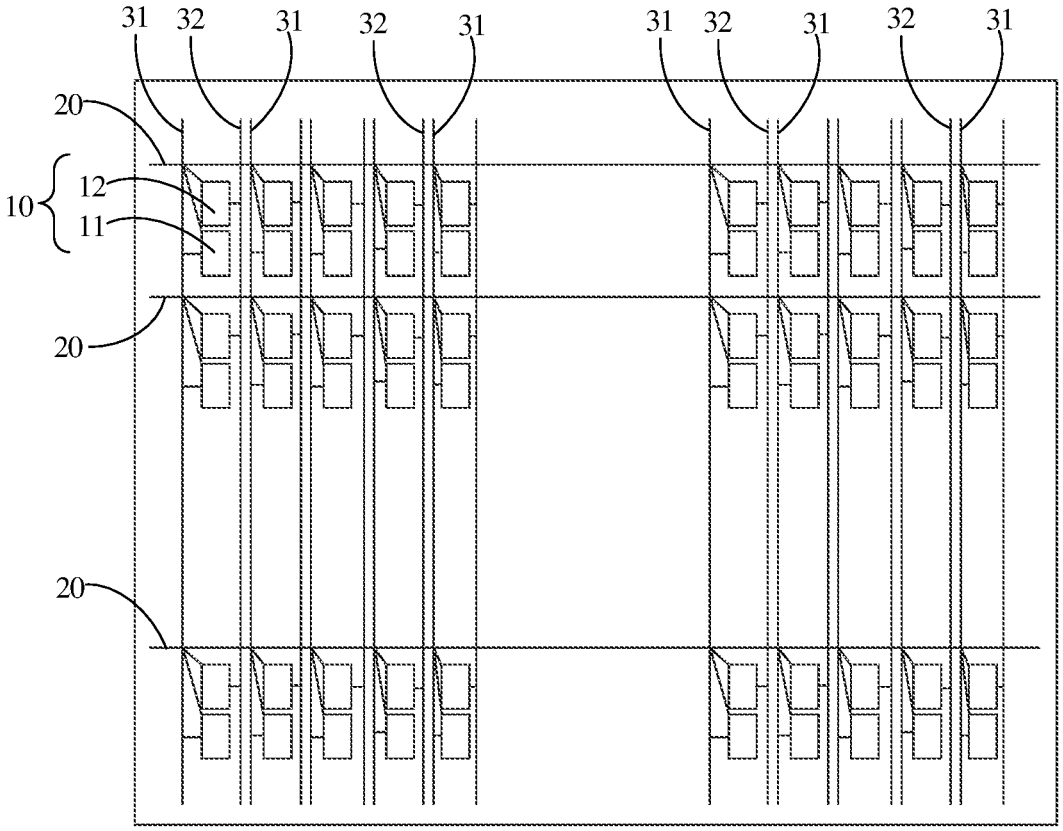
FIG. 2 is a schematic diagram showing the arrangement of pixel groups of the display panel according to an embodiment of the present disclosure.

Please refer to FIGS. 1-2. In one embodiment, the display panel 100 provided by the present disclosure includes a plurality of pixel groups 10 arranged in an array. Each pixel group 10 includes a first sub-pixel 11 and a second sub-pixel 12 which are adjacently arranged; a plurality of gate lines 20, in which the first sub-pixel 11 and the second sub-pixel 12 in a same row of the array are connected to one gate line of the plurality of gate lines 20; a plurality of first data lines 31, wherein the first sub-pixels 11 in a same column of the array are connected to one first data line of the plurality of first data lines 31; a plurality of second data lines 32, wherein the second sub-pixels 12 in a same column of the array are connected to one second data line of the plurality of second data lines 32; the first and the second data lines 31 and 32 are spacedly arranged, and a driving component (not shown in the figures) to which the gate lines 20, the first data lines 31 and the second data lines 32 are connected.

In this embodiment, the driving component is connected to the gate lines 20, and the first sub-pixels 11 and the second sub-pixels 12 in the same row are connected to the same gate line 20. When the display panel 100 performs row scanning operation, the first sub-pixels 11 in the same column are connected to the same first data line 31, and the second sub-pixels 12 in the same column are connected to the same second data line 31. When the user needs the display panel 100 to display in the high-resolution mode, the first sub-pixel 11 and the second sub-pixel 12 are charged through the first data line 31 and the second data line 32, respectively, so that the pixel voltages of the first sub-pixel 11 and the second sub-pixel 12 are corresponding gray-scale voltages. Taking the display panel 100 with 1080 gate lines and 3840 data lines as an example, when the pixel voltages of the first sub-pixel 11 and the second sub-pixel 12 are corresponding their gray-scale voltages, the resolution of the display panel 100 is 2160*1920, reaching to a high resolution.

When the user needs the display panel 100 to display in a wide angle mode, a corresponding gray-scale voltage is input to the first sub-pixel 11 and a target voltage is input to the second sub-pixel 12 at the same time. There is a fixed voltage difference between the target voltage and the gray-scale voltage of the first sub-pixel 11. For example, the display panel 100 has 256 gray scales ranging from 0 to 255, and the fixed voltage difference is 30 gray scales. When the gray scale level corresponding to the first sub-pixel 11 is 100, the gray scale level corresponding to the input target voltage of the second sub-pixel 12 is 70; when the gray scale level corresponding to the first sub-pixel 11 is 101, the gray scale level corresponding to the input target voltage of the second sub-pixel 12 is 71. It can be understood that the fixed voltage difference is not limited to the above-mentioned 30 gray scales, but may be other values. The gray scale level of the first sub-pixel 11 may also be smaller than that of the second sub-pixel 12. For example, when the gray scale level corresponding to the gray scale voltage of the first sub-pixel 11 is 100, the gray scale level corresponding to the input target voltage of the second sub-pixel 12 is 130, as long as the gray scale level between the first sub-pixel 11 and the second sub-pixel 12 is not identical and a difference exists between the gray scale values.

The gray scale level of the first sub-pixel 11 is higher than that of the second sub-pixel 12. When human eyes look at the display panel 100 in front, the first sub-pixel 11 is brighter than the second sub-pixel 12, but the first sub-pixel 11 and the second sub-pixel 12 feel moderate brightness to human eyes after neutralization. The liquid crystal to human eyes are different in position, and the gray scale levels perceived by human eyes will be different. When human eyes look at the display panel 100 from the side, the first sub-pixel 11 is darker than the second sub-pixel 12, but the first sub-pixel 11 and the second sub-pixel 12 will show a moderate brightness after neutralization. Therefore, no matter whether the human eyes look at the display panel 100 in front or by side, the difference in display effect is rather marginal without any color deviation. The display panel 100 is well behaved in wide view mode.

For above, in the present disclosure, the driving component is connected to the gate lines 20. The first sub-pixels 11 and the second sub-pixels 12 in the same column are connected to the same gate line 20, while the first sub-pixels 11 in the same column are connected to the same first data line 31; the second sub-pixels 12 in the same column are connected to the same second data line 32. The first sub-pixels and the second sub-pixels are both open during line scanning for the display panel. When a user requires different display modes, gray-scale voltages corresponding to different display modes are input to the first sub-pixels 11 and the second sub-pixels 12 through the first data lines 31 and the second data lines 32, respectively. The display panel 100 can be switched between the high-resolution mode and the wide angle mode meeting various display requirements of the user.

Referring to FIG. 1, in one embodiment, the driving component includes a main board circuit 41 connected with a timing controller 42; a gate driver 43 connected to the timing controller 42 and the plurality of gate lines 20; and a source driver 44 connected to the timing controller 42, the first data lines 31 and the second data lines 32.

In the present embodiment, when receiving an input signal, the timing controller 42 separates red, green and blue data from the input signal, and decomposes the red, green and blue data into different gray-scale voltages through the source driver 44. When the display panel 100 is in the high-resolution mode, the gray-scale voltages are input to the corresponding first sub-pixels 11 and second sub-pixels 12 through the source driver 44 and the first and second data lines 31 and 32, respectively.

When the display panel 100 is in the wide angle mode, the gray-scale voltage is input to the corresponding first sub-pixel 11 through the source driver 44 and the first data line 31, and the target voltage is input to the corresponding second sub-pixel 12 through the source driver 44 and the second data line 32 in each pixel group. The target voltage and the gray scale voltage of the first sub-pixels has a fixed voltage difference. For example, the display panel 100 has a voltage of 0-255 for 256 gray scales and a fixed voltage difference of 30 gray scales. When the gray scale level corresponding to the gray scale voltage of the first sub-pixel 11 is 100, the gray scale level corresponding to the input target voltage of the second sub-pixel 12 is 70, and when the gray scale level corresponding to the gray scale voltage of the first sub-pixel 11 is 101, Then the gray scale level corresponding to the target voltage input by the second sub-pixel 12 is 71. The fixed voltage difference can be pre-stored in the memory of the display panel 100. When the gray scale voltage of the first sub-pixel 11 is known, the target voltage can be calculated from the gray scale voltage of the first sub-pixel 11 and the fixed voltage difference retrieved from the memory.

In an embodiment, the timing controller 42 includes a control pin 421, and the driving component further includes a switch circuit 50 connected to the control pin 421 of the timing controller 42. The switch circuit 50 includes a pull-up resistor R, a control switch S and a pull-up power supply VDD which is connected to the control pin 421 via the control switch S and grounded via the control switch S and the pull-up resistor R. It can be understood that the switch circuit 50 can also be arranged in other circuit forms.

In the present embodiment, the level state of the control pin 421 is controlled by the switch circuit 50. When the switch circuit 50 is closed, the control pin 421 is at a high level, and when the switch circuit 50 is open, the control pin 421 is at a low level.

When the control pin 421 is high, the corresponding display mode is the high resolution mode, and when the control pin 421 is low, the corresponding display mode is the wide angle mode. Or in another scenario, when the control pin 421 is high, the corresponding display mode is the wide angle mode, and when the control pin 421 is low, the corresponding display mode is the high resolution mode.

In an embodiment, the control switch S is a physical key switch, which can be arranged on an infrared remote controller. For example, the user presses the physical key switch on the infrared remote controller to control the switch circuit 50 to turn on and off. The timing controller 42 receives the control signal triggered by the physical key switch. For example, the physical key switch can be turned on or off after being triggered. When the physical key switch is turned on, the timing controller 42 receives a high-level control signal, and when the physical key switch is turned off, the timing controller 42 receives a low-level control signal.

In another embodiment, the control switch S is an electronic switch, for example, the electronic switch may be a diode, a triode, etc., The electronic switch is turned on and off by software control switch circuit 50. The timing controller 42 receives control signals generated by the electronic switch when being triggered. For example, the electronic switch can be turned on or turned off. When the electronic switch is turned on, the timing controller 42 receives a high-level control signal, while when the electronic switch is turned off, the timing controller 42 receives a low-level control signal.

Figure 3:
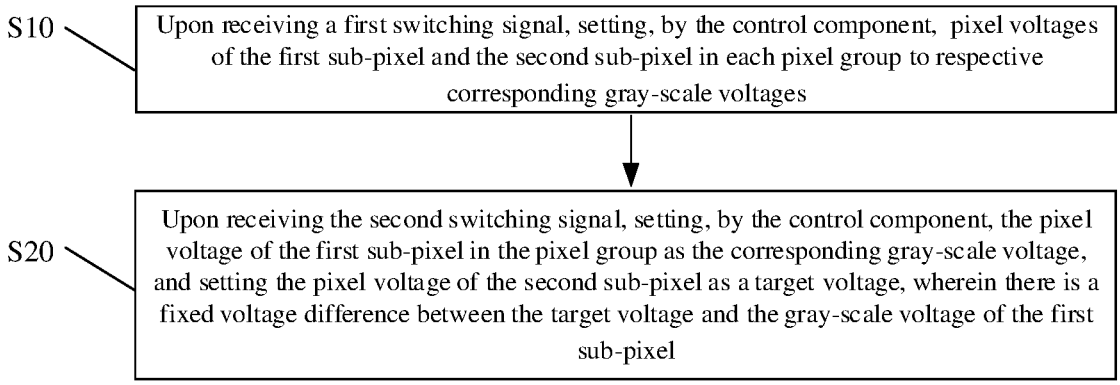
FIG. 3 is a flow chart showing a method of controlling a display panel according to an embodiment of the present disclosure.

FIG. 3 is referred to, in order to achieve the above object, another aspect of the present disclosure provides a method of a display panel. The display panel comprises a plurality of pixel groups arranged in an array, in which each pixel group includes a first sub-pixel and a second sub-pixel which are adjacently arranged; a plurality of gate lines, where the first sub-pixels and the second sub-pixels in a same row of the array are connected to one gate line of the plurality of gate lines; a plurality of first data lines, where the first sub-pixels in a same column of the array are connected to one first data line of the plurality of first data lines; a plurality of second data lines, where the second sub-pixels in a same column of the array are connected to one second data line of the plurality of second data lines; the first and the second data lines are spacedly arranged, a control component to which the gate lines, the first data lines and the second data lines are connected, the control method further comprises:

operation S10, upon receiving a first switching signal, setting, by the control component, pixel voltages of the first sub-pixel and the second sub-pixel in each pixel group to respective corresponding gray-scale voltages; and operation S20, upon receiving a second switching signal, setting, by the control component, the pixel voltage of the first sub-pixel in each pixel group as the corresponding gray-scale voltage, and setting the pixel voltage of the second sub-pixel in this pixel group as a target voltage, where there is a fixed voltage difference between the target voltage and the gray-scale voltage of the first sub-pixel.

In the present embodiment, the driving component is connected to the gate line, and the first sub-pixels and the second sub-pixels in the same row are connected to the same gate line. When the display panel performs row scanning operation, the first sub-pixels in the same column are connected to the same first data line, and the second sub-pixels in the same column are connected to the same second data line. When the user needs the display panel to display in the high-resolution mode, the control circuit is controlled to transmit the first switch signal, the first sub-pixels and the second sub-pixels are controlled by the control component and charged through the first data lines and the second data lines, respectively, so that the pixel voltages of the first sub-pixel and the second sub-pixel in each pixel group are corresponding gray-scale voltages. Taking the display panel with 1080 gate lines and 3840 data lines as an example, when the pixel voltages of the first sub-pixel and the second sub-pixel are corresponding their gray-scale voltages, the resolution of the display panel 100 is 2160*1920, reaching to a high resolution.

When the user needs the display panel to display in the wide angle mode, the switch circuit is controlled to transmit the second switch signal, and a corresponding gray-scale voltage is controlled by the control component and input to the first sub-pixel in each pixel group and a target voltage is controlled by the control component and input to the second sub-pixel in this pixel group at the same time. There is a fixed voltage difference between the target voltage and the gray-scale voltage of the first sub-pixel. For example, the display panel has 256 gray scales ranging from 0 to 255, and the fixed voltage difference is gray scales. When the gray scale level corresponding to a first sub-pixel is 100, the gray scale level corresponding to the input target voltage of a second sub-pixel is 70; when the gray scale level corresponding to the first sub-pixel is 101, the gray scale level corresponding to the input target voltage of the second sub-pixel is 71. It can be understood that the fixed voltage difference is not limited to the above-mentioned 30 gray scales, but may be other values. The gray scale level of the first sub-pixel may also be smaller than that of the second sub-pixel. For example, when the gray scale level corresponding to the gray scale voltage of the first sub-pixel is 100, the gray scale level corresponding to the input target voltage of the second sub-pixel is 130, as long as the gray scale level between the first sub-pixel and the second sub-pixel is not identical and a difference exists between the gray scale values.

The gray scale level of the first sub-pixel is higher than that of the second sub-pixel. When human eyes look at the display panel in front, the first sub-pixel is brighter than the second sub-pixel, but the first sub-pixel and the second sub-pixel feel moderate brightness to human eyes after neutralization. The liquid crystal to human eyes are different in position, and the gray scale levels perceived by human eyes will be different. When human eyes look at the display panel from the side, the first sub-pixel is darker than the second sub-pixel, but the first sub-pixel and the second sub-pixel will show a moderate brightness after neutralization. Therefore, no matter whether the human eyes look at the display panel in front or by side, the difference in display effect is rather marginal without any color deviation. The display panel is well behaved in wide view mode.

For above, in the present disclosure, the driving components are connected to the gate lines. The first sub-pixels and the second sub-pixels in the same column are connected to the same gate line, while the first sub-pixels in the same column are connected to the same first data line; the second sub-pixels in the same column are connected to the same second data line. The first sub-pixels and the second sub-pixels are both open during line scanning for the display panel. When a user requires different display modes, gray-scale voltages corresponding to different display modes are input to the first sub-pixels and the second sub-pixels through the first data lines and the second data lines, respectively. The display panel can be switched between the high-resolution mode and the wide angle mode, meeting various display requirements of the user.

Figure 4:
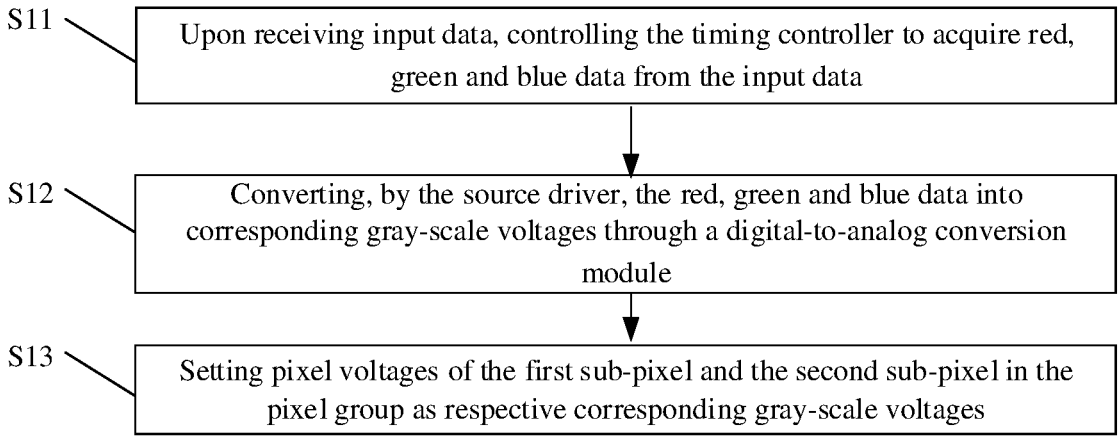
FIG. 4 is a flow chart showing details of operation S10 in the method of controlling a display panel according to an embodiment of the present disclosure.

Referring to FIG. 4, in an embodiment, the control component includes a main board circuit, a timing controller, a source driver and a gate driver. The timing controller is connected with the motherboard circuit via the gate driver and the source driver. The operation S10 further includes:

operation S11, upon receiving input data, controlling the timing controller to acquire red, green and blue data from the input data;

operation S12, converting, by the source driver, the red, green and blue data into corresponding gray-scale voltages through a digital-to-analog conversion module; and operation S13, setting pixel voltages of the first sub-pixel and the second sub-pixel in each pixel group as respective corresponding gray-scale voltages.

In the present embodiment, when receiving an input signal, the timing controller separates red, green and blue data from the input signal, and decomposes the red, green and blue data into different gray-scale voltages through the source driver and the its digital-to-analog converting module integrated in the source driver. When the display panel is in the high-resolution mode, the gray-scale voltages are input to the corresponding first sub-pixels and second sub-pixels through the source driver and the first and second data lines, respectively.

Figure 5:
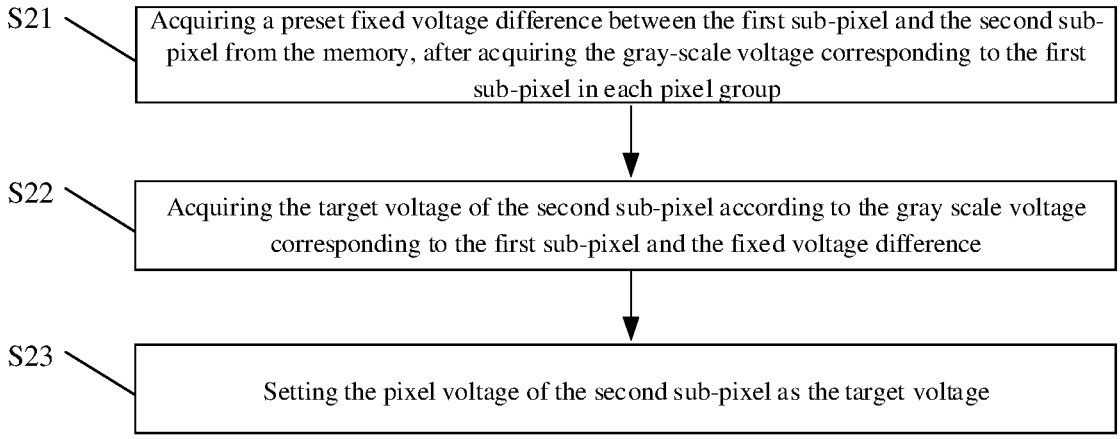
FIG. 5 is a flow chart showing details of operation S20 in the method of controlling a display panel according to an embodiment of the present disclosure.

Referring to FIG. 5, in an embodiment, the display panel further includes a memory, and when the second switching signal is received, the operation 20 includes:

operation S21, acquiring a preset fixed voltage difference between the first sub-pixel and the second sub-pixel in each pixel group from the memory, after acquiring the gray-scale voltage corresponding to the first sub-pixel;

operation S22, acquiring the target voltage of the second sub-pixel according to the gray scale voltage corresponding to the first sub-pixel and the fixed voltage difference; and operation S23, setting the pixel voltage of the second sub-pixel as the target voltage.

In the present embodiment, the gray-scale voltage in each pixel group is input to the corresponding first sub-pixel 11 through the source driver 44 and the first data line 31, and the target voltage is input to the corresponding second sub-pixel 12 through the source driver 44 and the second data line 32. The target voltage and the gray scale voltage of the first sub-pixels has a fixed voltage difference. For example, the display panel has a voltage of 0-255 for 256 gray scales and a fixed voltage difference of 30 gray scales. When the gray scale level corresponding to the gray scale voltage of the first sub-pixel is 100, the gray scale level corresponding to the input target voltage of the second sub-pixel is 70, and when the gray scale level corresponding to the gray scale voltage of the first sub-pixel is 101, Then the gray scale level corresponding to the target voltage input by the second sub-pixel is 71. The fixed voltage difference can be pre-stored in the memory of the display panel. When the gray scale voltage of the first sub-pixel is known, the target voltage can be calculated from the gray scale voltage of the first sub-pixel and the fixed voltage difference retrieved from the memory.

Figure 6:
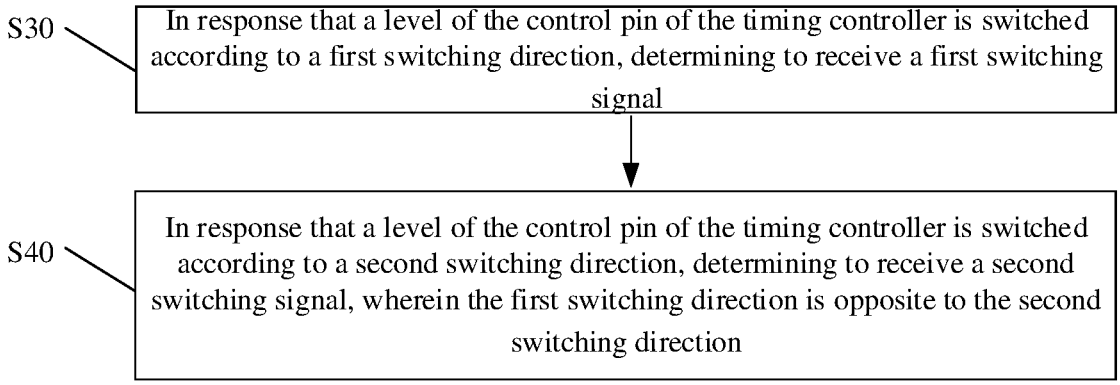
FIG. 6 is a flow chart showing a method of controlling a display panel according to another embodiment of the present disclosure.

Referring to FIG. 6, in an embodiment, the method of controlling the display panel further includes:

operation S30, in response that a level of a control pin of the timing controller is switched according to a first switching direction, determining to receive a first switching signal; and operation S40, in response that a level of the control pin of the timing controller is switched according to a second switching direction, determining to receive a second switching signal, wherein the first switching direction is opposite to the second switching direction.

In the present embodiment, the timing controller includes a control pin, and the driving component further includes a switch circuit connected to the control pin of the timing controller. In one embodiment, the switch circuit includes a pull-up resistor, a control switch and a pull-up power supply, wherein the pull-up power supply is connected to the control pin via the control switch, and the pull-up power supply is grounded via the control switch and the pull-up resistor. It can be understood that the switch circuit can also be arranged in other circuit forms.

In the present embodiment, the level of the control pin is controlled by the switch circuit. When the level of the control pin is switched according to a first switching direction, that is, when the switch circuit is closed, the control pin changes from low level to high level, it is determined that the first switching signal is received. When the level of the control pin is switched according to a second switching direction, that is, when the switch circuit is opened, the control pin changes from high level to low level, it is determined that the second switching signal is received. It can be understood that the first switching information can also be generated when the control pin changes from high level to low level, and correspondingly, the second switching information is generated when the control pin changes from low level to high level.

When the level of the control pin of the timing controller is switched to the high resolution mode according to the first switching direction, the level of the controlled pin is switched to the wide angle mode according to the second switching direction. On the contrary, when the level of the control pin of the timing controller is switched in the wide angle mode according to the first switching direction, the level of the controlled pin is switched in the high resolution mode according to the second switching direction.

In order to achieve the above object, another aspect of the present disclosure provides a method of a display panel based on the display panel 100. The display panel includes a plurality of pixel groups arranged in an array, a plurality of gate lines, a plurality of first data lines, a plurality of second data lines, a control component, and a memory. Each pixel group includes a first sub-pixel and a second sub-pixel which are adjacently arranged. First sub-pixels and second sub-pixels in a same row of the array are connected to one gate line of the plurality of gate lines. The first sub-pixels in a same column of the array are connected to one first data line of the plurality of first data lines. The second sub-pixels in a same column of the array are connected to one second data line of the plurality of second data lines. The first data lines and the second data lines are spacedly arranged, and the gate lines, the first data lines and the second data lines are connected to the control component. The control method further include:

operation S10, upon receiving a first switching signal, setting, by the control component, pixel voltages of the first sub-pixel and the second sub-pixel in the pixel group to respective corresponding gray-scale voltages;

operation S50, upon receiving a second switching signal, acquiring a preset fixed voltage difference between the first sub-pixel and the second sub-pixel in each pixel group from the memory, acquiring a target voltage of the second sub-pixel according to a gray scale voltage corresponding to the first sub-pixel, and the fixed voltage difference, and setting the pixel voltage of the second sub-pixel as the target voltage.

In the present embodiment, the operations of the method of controlling the display panel is performed after combining the operations S10 as well as S21-S23 as described above. It has at least the technical effects as above, which will not be repeated herein.

It should be noted that in this document, the terms "comprising" "including" or any other variation thereof are intended to cover a non-exclusive inclusion, such that a process, method, article, or system that includes a list of elements includes not only those elements but also other elements not expressly listed, or elements inherent to such process, method, article, or system. Without further restrictions, an element defined by the statement "includes an" does not exclude the presence of another identical element in a process, method, article, or system including the element.

The aforementioned serial numbers regarding the embodiments of the present application are for description only and do not represent the superiority and inferiority of the embodiments.

From the above description of the embodiments, those skilled in the art can clearly understand that the method of the above embodiments can be implemented by means of software plus necessary general-purpose hardware platforms. Of course, it can also be implemented by means of hardware, but in many cases the former is a better embodiment. Based on this understanding, the technical solution of the present application can be embodied in the form of a software product, which is stored in a storage medium (such as ROM/RAM, magnetic disk, optical disk) as described above, and includes several instructions to cause a terminal device (which can be a mobile phone, a computer, a server, an air conditioner, or a network device, etc.) to perform the methods described in various embodiments of the present application.

The above is only the preferred embodiment of the present disclosure and is not therefore limiting the scope of the present disclosure. Any equivalent structure or process change made by using the contents of the present specification and drawings, or directly or indirectly applied in other related technical fields, shall be included in the protection scope of the present disclosure.

What is claimed is:

1. A display panel, comprising:

a plurality of pixel groups arranged in an array, wherein each pixel group comprises a first sub-pixel and a second sub-pixel which are adjacently arranged;

a plurality of gate lines, wherein first sub-pixels and second sub-pixels in a same row of the array are connected to one gate line of the plurality of gate lines;

a plurality of first data lines, wherein the first sub-pixels in a same column of the array are connected to one first data line of the plurality of first data lines;

a plurality of second data lines, wherein the second sub-pixels in a same column of the array are connected to one second data line of the plurality of second data lines; the first and the second data lines are spacedly arranged, and a driving component to which the gate lines, the first data lines and the second data lines are connected;

wherein the driving component comprises:

a main board circuit connected with a timing controller, wherein the timing controller comprises a control pin;

a switch circuit connected to the control pin of the timing controller;

a gate driver connected to the timing controller and the plurality of gate lines; and a source driver connected to the timing controller, the first data lines and the second data lines, wherein the switch circuit comprises a pull-up resistor, a control switch and a pull-up power supply, the pull-up power supply is connected to the control pin via the control switch, and the pull-up power supply is grounded via the control switch and the pull-up resistor.

2. The display panel according to claim 1, wherein the control switch is a physical key switch, and the timing controller is to receive a control signal triggered by the physical key switch.

3. The display panel according to claim 1, wherein the control switch is an electronic switch, the electronic switch is controlled on and off by a software, and the timing controller is to receive a control signal triggered by the electronic switch.

4. A method of controlling a display panel, wherein the display panel comprises a plurality of pixel groups arranged in an array, a plurality of gate lines, a plurality of first data lines, a plurality of second data lines and a control component, wherein each pixel group comprises a first sub-pixel and a second sub-pixel which are adjacently arranged; first sub-pixels and second sub-pixels in a same row of the array are connected to one gate line of the plurality of gate lines; the first sub-pixels in a same column of the array are connected to one first data line of the plurality of first data lines; the second sub-pixels in a same column of the array are connected to one second data line of the plurality of second data lines; the first data lines and the second data lines are spacedly arranged, and the gate lines, the first data lines and the second data lines are connected to the control component, wherein the method comprises:

upon receiving a first switching signal, setting, by the control component, pixel voltages of the first sub-pixel and the second sub-pixel in the pixel group to respective corresponding gray-scale voltages; and upon receiving the second switching signal, setting, by the control component, the pixel voltage of the first sub-pixel in the pixel group as the corresponding gray-scale voltage, and setting the pixel voltage of the second sub-pixel as a target voltage, wherein there is a fixed voltage difference between the target voltage and the gray-scale voltage of the first sub-pixel.

5. The method according to claim 4, wherein the control component comprises a main board circuit, a timing controller, a source driver and a gate driver, wherein the timing controller is connected with the main board circuit, the gate driver and the source driver, and the operation of upon receiving a first switching signal, setting, by the control component, pixel voltages of the first sub-pixel and the second sub-pixel in the pixel group to respective corresponding gray-scale voltages, comprises:

upon receiving input data, controlling the timing controller to acquire red, green and blue data from the input data;

converting, by the source driver, the red, green and blue data into corresponding gray-scale voltages through a digital-to-analog conversion module; and setting pixel voltages of the first sub-pixel and the second sub-pixel as respective corresponding gray-scale voltages.

6. The method according to claim 5, wherein the display panel further comprises a memory, and the operation of upon receiving the second switching signal, setting, by the control component, the pixel voltage of the first sub-pixel in the pixel group as the corresponding gray-scale voltage, and setting the pixel voltage of the second sub-pixel as a target voltage, comprises:

acquiring a preset fixed voltage difference between the first sub-pixel and the second sub-pixel from the memory, after acquiring the gray-scale voltage corresponding to the first sub-pixel;

acquiring the target voltage of the second sub-pixel according to the gray scale voltage corresponding to the first sub-pixel and the fixed voltage difference; and setting the pixel voltage of the second sub-pixel as the target voltage.

7. The method according to claim 4, wherein further comprising:

in response that a level of a control pin of the timing controller is switched according to a first switching direction, determining to receive a first switching signal; and in response that a level of the control pin of the timing controller is switched according to a second switching direction, determining to receive a second switching signal;

wherein the first switching direction is opposite to the second switching direction.

8. The method according to claim 4, wherein the control component further comprises:

a switch circuit connected to a control pin of the timing controller.

9. The method according to claim 8, wherein the switch circuit comprises a pull-up resistor, a control switch and a pull-up power supply, wherein the pull-up power supply is connected to the control pin via the control switch, and the pull-up power supply is grounded via the control switch and the pull-up resistor.

10. The method according to claim 9, wherein the control switch is a physical key switch, and the timing controller is to receive a control signal triggered by the physical key switch.

11. The method according to claim 9, wherein the control switch is an electronic switch, the electronic switch is controlled on and off by a software, and the timing controller is to receive a control signal triggered by the electronic switch.

12. A method of controlling a display panel, wherein the display panel comprises a plurality of pixel groups arranged in an array, a plurality of gate lines, a plurality of first data lines, a plurality of second data lines, a control component, and a memory, wherein each pixel group comprises a first sub-pixel and a second sub-pixel which are adjacently arranged; first sub-pixels and second sub-pixels in a same row of the array are connected to one gate line of the plurality of gate lines; the first sub-pixels in a same column of the array are connected to one first data line of the plurality of first data lines; the second sub-pixels in a same column of the array are connected to one second data line of the plurality of second data lines; the first data lines and the second data lines are spacedly arranged, and the gate lines, the first data lines and the second data lines are connected to the control component, wherein the method comprises:

upon receiving a first switching signal, setting, by the control component, pixel voltages of the first sub-pixel and the second sub-pixel in each pixel group to respective corresponding gray-scale voltages;

upon receiving a second switching signal, acquiring a preset fixed voltage difference between a first sub-pixel and a second sub-pixel in the pixel group from the memory, acquiring a target voltage of the second sub-pixel according to a gray scale voltage corresponding to the first sub-pixel, and the fixed voltage difference, and setting the pixel voltage of the second sub-pixel as the target voltage.

13. The method according to claim 12, wherein the control component comprises a main board circuit, a timing controller, a source driver and a gate driver, wherein the timing controller is connected with the main board circuit, the gate driver and the source driver, and the operation of upon receiving a first switching signal, setting, by the control component pixel voltages of the first sub-pixel and the second sub-pixel in the pixel group to respective corresponding gray scale voltages, comprises:

upon receiving input data, controlling the timing controller to acquire red, green and blue data from the input data;

converting, by the source driver, the red, green and blue data into corresponding gray-scale voltages through a digital-to-analog conversion module; and setting pixel voltages of the first sub-pixel and the second sub-pixel as respective corresponding gray-scale voltages.

14. The method according to claim 13, wherein the display panel further comprises a memory, and the operation of upon receiving the second switching signal, setting, by the control component, the pixel voltage of the first sub-pixel in each pixel group as the corresponding gray-scale voltage, and setting the pixel voltage of the second sub-pixel as a target voltage, comprises:

acquiring a preset fixed pressure difference between the first sub-pixel and the second sub-pixel from the memory, after acquiring the gray-scale voltage corresponding to the first sub-pixel;

acquiring the target voltage of the second sub-pixel according to the gray scale voltage corresponding to the first sub-pixel and the fixed voltage difference; and setting the pixel voltage of the second sub-pixel as the target voltage.

15. The method according to claim 12, wherein further comprising:

in response that a level of a control pin of the timing controller is switched according to a first switching direction, determining to receive a first switching signal; and in response that a level of the control pin of the timing controller is switched according to a second switching direction, determining to receive a second switching signal;

wherein the first switching direction is opposite to the second switching direction.

16. The method according to claim 12, wherein the control component further comprises:

a switch circuit connected to a control pin of the timing controller.

17. The method according to claim 16, wherein the switch circuit comprises a pull-up resistor, a control switch and a pull-up power supply, wherein the pull-up power supply is connected to the control pin via the control switch, and the pull-up power supply is grounded via the control switch and the pull-up resistor.

18. The method according to claim 17, wherein the control switch is a physical key switch, and the timing controller is to receive a control signal triggered by the physical key switch, or the control switch is an electronic switch, the electronic switch is controlled on and off by a software, and the timing controller is to receive a control signal triggered by the electronic switch.

* * * * *